US009732974B2

(12) United States Patent
Frank

(10) Patent No.: US 9,732,974 B2
(45) Date of Patent: Aug. 15, 2017

(54) SYSTEM AND METHOD FOR WIRING-RELAY CONFIGURATION IN DIGITAL THERMOSTATS

(75) Inventor: Andrew Frank, Woodland Hills, CA (US)

(73) Assignee: Digi International Inc., Minnetonka, MN (US)

( * ) Notice: Subject to any disclaimer, the term of this patent is extended or adjusted under 35 U.S.C. 154(b) by 1188 days.

(21) Appl. No.: 13/585,135

(22) Filed: Aug. 14, 2012

(65) Prior Publication Data

US 2014/0048608 A1 Feb. 20, 2014

(51) Int. Cl.

| | |
|---|---|
| ***F24F 11/00*** | (2006.01) |
| ***F24F 11/053*** | (2006.01) |
| ***G05D 23/00*** | (2006.01) |
| ***F25B 49/00*** | (2006.01) |

(52) U.S. Cl.

CPC ... *F24F 11/0012* (2013.01); *F24F 2011/0072* (2013.01)

(58) Field of Classification Search

CPC ..... F24F 2011/0068; F24F 11/006; F24F 2011/0061; F24F 2011/0063; F24F 2011/0071; F24F 11/0086; F24F 2011/0091; F24F 11/0012; F24F 2011/0067; G05D 23/1905; G05D 23/00

USPC ..... 236/1 B, 1 C, 51; 62/125, 126, 127

See application file for complete search history.

(56) References Cited

U.S. PATENT DOCUMENTS

| | | | | |
|---|---|---|---|---|
| 4,843,084 | A * | 6/1989 | Parker et al. | 700/277 |
| 4,884,214 | A * | 11/1989 | Parker et al. | 700/278 |
| 4,931,948 | A * | 6/1990 | Parker et al. | 700/277 |
| 5,065,813 | A * | 11/1991 | Berkeley | G05D 23/1917 165/11.1 |
| 5,555,269 | A * | 9/1996 | Friday, Jr. | G05B 19/0425 62/132 |
| 5,950,709 | A * | 9/1999 | Krueger | F24F 11/0012 165/11.1 |
| 7,844,764 | B2 * | 11/2010 | Williams | F24F 11/0009 700/19 |
| 8,523,083 | B2 * | 9/2013 | Warren | F24F 11/0012 200/50.08 |
| 2001/0048030 | A1 * | 12/2001 | Sharood | G05B 19/00 236/49.3 |
| 2002/0109011 | A1 * | 8/2002 | Fleckenstein | 236/49.3 |
| 2003/0073461 | A1 * | 4/2003 | Sinclair | G08C 17/02 455/557 |
| 2007/0220907 | A1 * | 9/2007 | Ehlers | 62/126 |
| 2007/0221741 | A1 * | 9/2007 | Wagner | F24F 11/0086 236/94 |
| 2007/0271006 | A1 * | 11/2007 | Golden | H02J 3/14 700/295 |
| 2008/0127197 | A1 * | 5/2008 | Abernathy et al. | 718/104 |
| 2009/0194601 | A1 * | 8/2009 | Flohr | 236/51 |

(Continued)

*Primary Examiner* — Henry Crenshaw

(74) *Attorney, Agent, or Firm* — Fogg & Powers LLC

(57) ABSTRACT

In a thermostat having a plurality of demand circuits and a thermostat controller, a method of controlling devices connected to the demand circuits. One or more demand circuits in a thermostat are connected to devices in an HVAC system. The thermostat is configured to associate each connected demand circuit with the device to which it is connected and control signals are routed from the thermostat controller to the one or more demand circuits to control devices associated with the demand circuits.

7 Claims, 11 Drawing Sheets

(56) References Cited

U.S. PATENT DOCUMENTS

| | | | | |
|---|---|---|---|---|
| 2012/0130679 | A1* | 5/2012 | Fadell | F24F 11/0012 702/183 |
| 2012/0248211 | A1* | 10/2012 | Warren | F24F 11/0012 236/1 C |
| 2014/0324229 | A1* | 10/2014 | Leen | G05D 23/19 700/276 |
| 2015/0163945 | A1* | 6/2015 | Barton | F24F 11/006 361/809 |

* cited by examiner

450

| RELAY WIRE | WIRE ASGN |
|---|---|
| R[1, 1] | RH |
| R[1, 0] | W |
| R[2, 1] | RC |
| R[2, 0] | Y |
| R[3, 1] | VENT+ |
| R[3, 0] | VENT- |
| R[4, 1] | GEOTHERMAL+ |
| R[4, 0] | GEOTHERMAL- |
| R[5, 1] | LIGHT+ |
| R[5, 0] | LIGHT- |

150

152

154

*FIG. 8*

SYSTEM AND METHOD FOR WIRING-RELAY CONFIGURATION IN DIGITAL THERMOSTATS

BACKGROUND

Digital Thermostats are designed for various heating and cooling HVAC systems. The system may be a single stage cooling or heating or perhaps a complex heat pump with dual stage cooling, heating, auxiliary heat, outsider air venting, etc. The thermostat detects various room and perhaps outside ambient conditions and based on these conditions activates certain relays to signal a service demand to the HVAC controller. These demand wires are typically color coded and, typically, are labeled (e.g., labels such as C, RX, O, B, RH, W, Y, G, A, L, T, E and Aux).

There are a variety of HVAC systems on the market today; there is no consistent naming convention when it comes to labeling control wires for such systems. Typically, a digital thermostat compatible with a particular HVAC system has either pre-assigned relay assignments or configuration options available, for instance, via the front panel. Relays in such systems are typically marked with a pre-assigned lettering to help the installer with installation. There remain a variety of 2, 3, 4, 5 or even 7 wires systems out there making the installation cumbersome and confusing.

What is needed is a system and method for configuring relays in HVAC system that is adaptable to HVAC systems having different relay naming conventions and different numbers of relays under control.

BRIEF DESCRIPTION OF THE FIGURES

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 8 illustrates a configuration table that can be used to configure the thermostat system of FIG. 5;

DETAILED DESCRIPTION

In the following detailed description of example embodiments of the invention, reference is made to specific examples by way of drawings and illustrations. These examples are described in sufficient detail to enable those skilled in the art to practice the invention, and serve to illustrate how the invention may be applied to various purposes or embodiments. Other embodiments of the invention exist and are within the scope of the invention, and logical, mechanical, electrical, and other changes may be made without departing from the subject or scope of the present invention. Features or limitations of various embodiments of the invention described herein, however essential to the example embodiments in which they are incorporated, do not limit the invention as a whole, and any reference to the invention, its elements, operation, and application do not limit the invention as a whole but serve only to define these example embodiments. The following detailed description does not, therefore, limit the scope of the invention, which is defined only by the appended claims.

Figure 1:
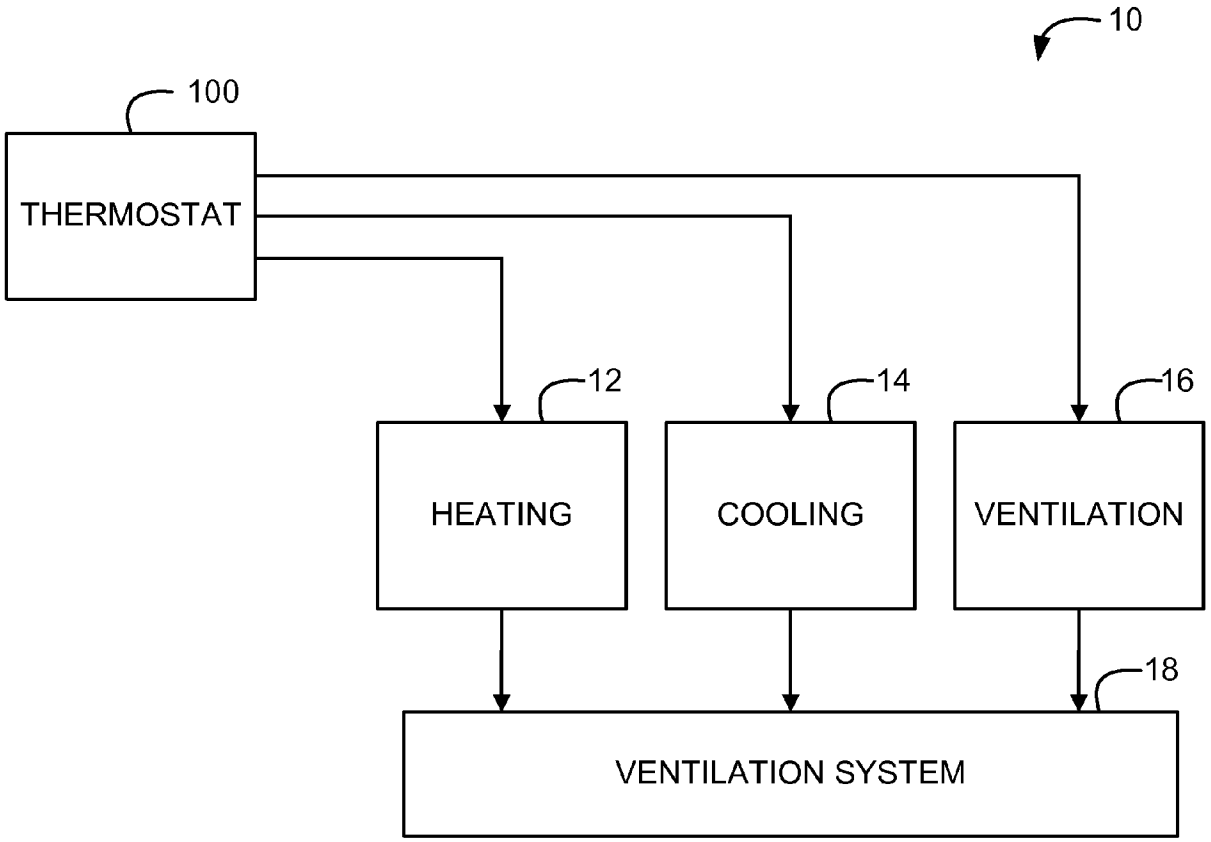
FIG. 1 illustrates an example heating, ventilation and cooling (HVAC) system.

An example heating, ventilation and cooling (HVAC) system is shown in FIG. 1. In the example shown in FIG. 1, system 10 includes a heating unit 12, a cooling unit 14 and a ventilation unit 16 connected to the ventilation system 18 used to manage a building's climate. In the example shown in FIG. 1, system 10 includes a thermostat system 100 that controls each of heating unit 12, cooling unit 14 and ventilation unit 16 when configured by the installer in the manner described below.

Figure 2:
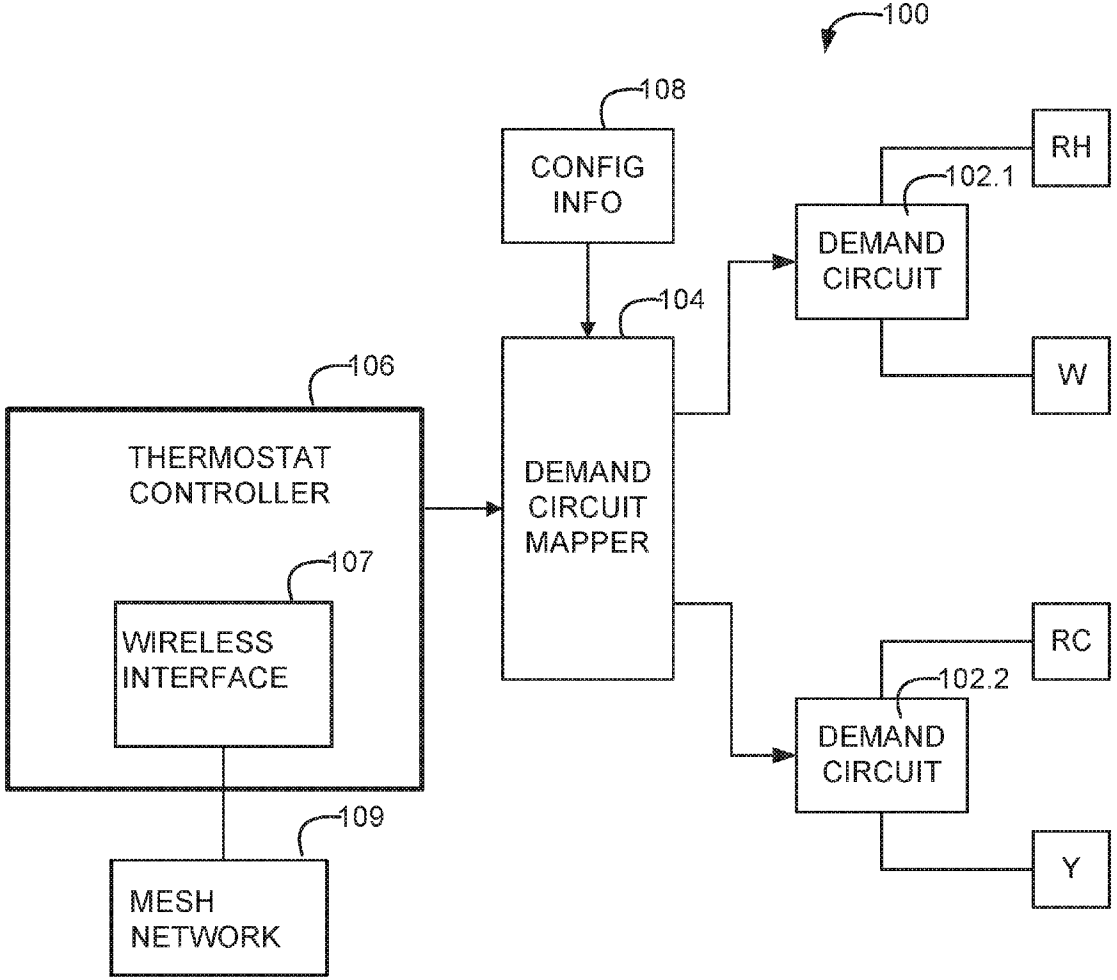
FIG. 2 illustrates an example thermostat system that can be used in the HVAC system of FIG. 1.

One example embodiment of thermostat system 100 is shown in FIG. 2. In the example shown in FIG. 2, thermostat system 100 includes a first demand circuit 102.1, a second demand circuit 101.2, a demand circuit mapper 104, and a thermostat controller 106. In the example shown in FIG. 2, demand circuits 102.1 and 102.2 are controlled via demand circuit mapper 104. In the embodiment shown in FIG. 2, configuration information used to configure how mapper 104 controls demand circuits 102.1 and 102.2 is read from, for instance, a configuration register 108. In one embodiment, the thermostat controller 106 includes a wireless interface 107 to a mesh network 109.

In the example shown, first demand circuit 102.1 is connected between wires RH and W; in the example shown, first demand circuit 102.1 serves to power a HVAC device such as a heating device off and on as needed. Similarly, demand circuit 102.2 is connected between wires RC and Y; in the example shown in FIG. 2, second demand circuit 102.2 serves to power a HVAC device such as a condenser or other cooling device off and on. In one example embodiment, wires RH and RC provide 24 VAC to their respective HVAC units via their corresponding demand circuits 102.1 and 102.2.

In the past, relay assignments in thermostats were fixed and non-changeable. Since relay functions were predetermined, oftentimes a relay would go unused if it was configured to control an HVAC function that was not needed. In addition, such thermostats could not be reconfigured to add, for instance, a new function to an existing thermostat 100.

To address this issue, in one example embodiment, thermostat 100 replaces pre-assigned, pre-marked relays with "Soft/Programmable Relays". Each relay is marked with R1, R2 . . . Rx instead of the typical HVAC lettering. An installer installing thermostat 100 uses a Smartphone, IPod, laptop, etc to select one of the supported generic system configurations, or connects via a network to an active database of available system configurations and selects a configuration from that set of configurations. In one such approach, the installer simply selects the Vendor and Model number of the HVAC system to receive a list of possible relay configurations.

Figure 3:
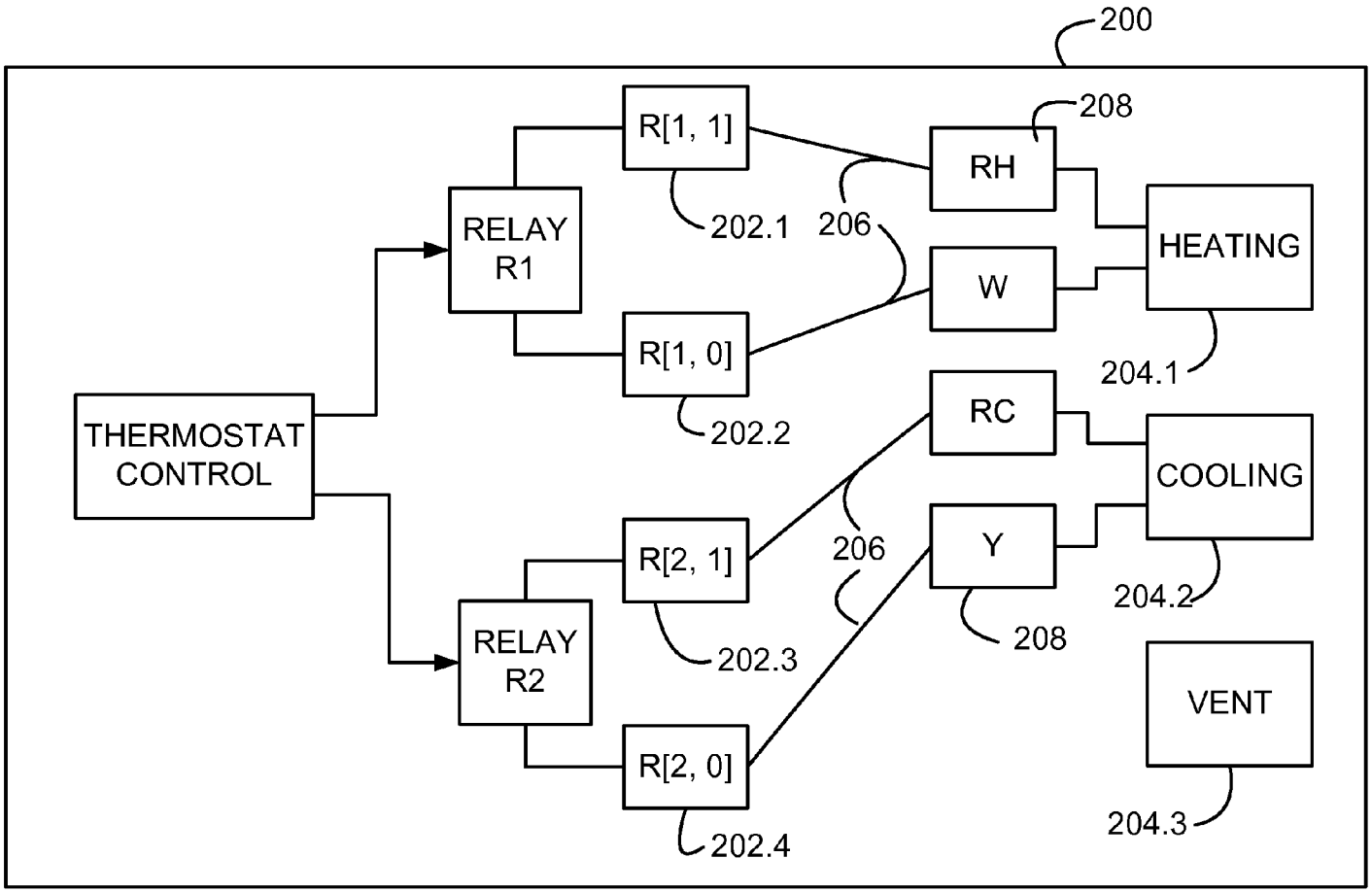
FIG. 3 illustrates a user interface that can be used to configure the thermostat system of FIG. 2.

In one example embodiment, an Install/Configurator application executing on a portable device is used. In one example embodiment, Install/Configurator application includes a graphical user interface 200 such as is shown in FIG. 3. In one example embodiment, such as shown in FIG. 3, graphical user interface 200 displays a wiring diagram depicting wire assignment of the Soft Relays. In the example embodiment shown in FIG. 3, each relay includes two connections. For the relay R1, the connections 202 are labeled as R[1,1] and R[1,0]. For the relay R2, the connections 202 are labeled as R[2,1] and R[2,0]. Devices to be controlled may be labeled with generic connection names, or can be labeled with the manufacturer's name as necessary. In the example embodiment shown in FIG. 3, generic heating and cooling labels are used.

To configure thermostat 100, the installer pulls up graphical interface 200 and displays the available relays and the possible connections. The installer connects the relay connections 202 as desired. In the example shown in FIG. 3, the installer touches the connection R[1,1] followed by the device connection 208 and a line 206 is drawn between the two connections. Once configuration is finished a configuration information table such as that shown as table 300 in FIG. 4 is used to route the appropriate control signals to the associated device connection.

Figure 4:
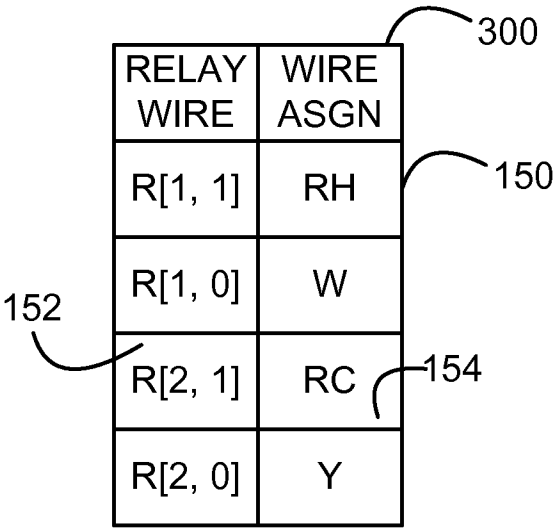
FIG. 4 illustrates a configuration table that can be used to configure the thermostat system of FIG. 2.

A mapping which can be used to configure the thermostat 100 of FIG. 3 is shown in FIG. 4. In the mapping shown in FIG. 4, each entry 150 includes a relay wire identifier 152 and a wire assignment 154. In one embodiment, the mapping is downloaded to thermostat 100 and stored in configuration register 108, where it is used to direct control signals from thermostat controller 106 to their appropriate demand circuit 102.

In one such embodiment, the installer can override and manually assign the relays for a given function. An application executing in thermostat 100 downloads this Soft Relay assignment via, for instance, the cloud to the Thermostat 100 and this information is then stored in the Thermostat non-volatile memory (e.g., configuration register 108) going forward.

Soft relays lower the number of relays required to support a variety of applications and support adding additional functions in the future, such as outside air venting, humidity control, etc., that are not supportable in today's preset thermostats.

The above approach also makes installation easier, faster and more bulletproof, thus lowering cost. A user can wire the thermostat anyway he likes (Except, R, C) and then he can do the same at the main HVAC unit. In one example embodiment, the user is prompted to enter the manufacture and model number of the HVAC unit/controller and is prompted to read and enter the wiring assignment at the HVAC unit and each thermostat. The application then determines the proper configuration for each thermostat and downloads the appropriate configuration, thus eliminating any chance of incorrect wiring.

A soft relay-based thermostat such as thermostat 100 has the potential to reduce the number of relays and attendant control circuitry required in a thermostat. It also allows the addition of additional functions to be controlled by that thermostat in the future.

In one embodiment, demand circuits 102.1 and 102.2 include relays. In another embodiment, semiconductor devices such as triacs are used in demand circuits 102.1 and 102.2 to provide power to the HVAC units.

As noted above, in the example thermostat system 100 of FIG. 2, demand circuits 102.1 and 102.2 are configured via demand circuit mapper 104 using information stored in configuration register 108.

Figure 5:
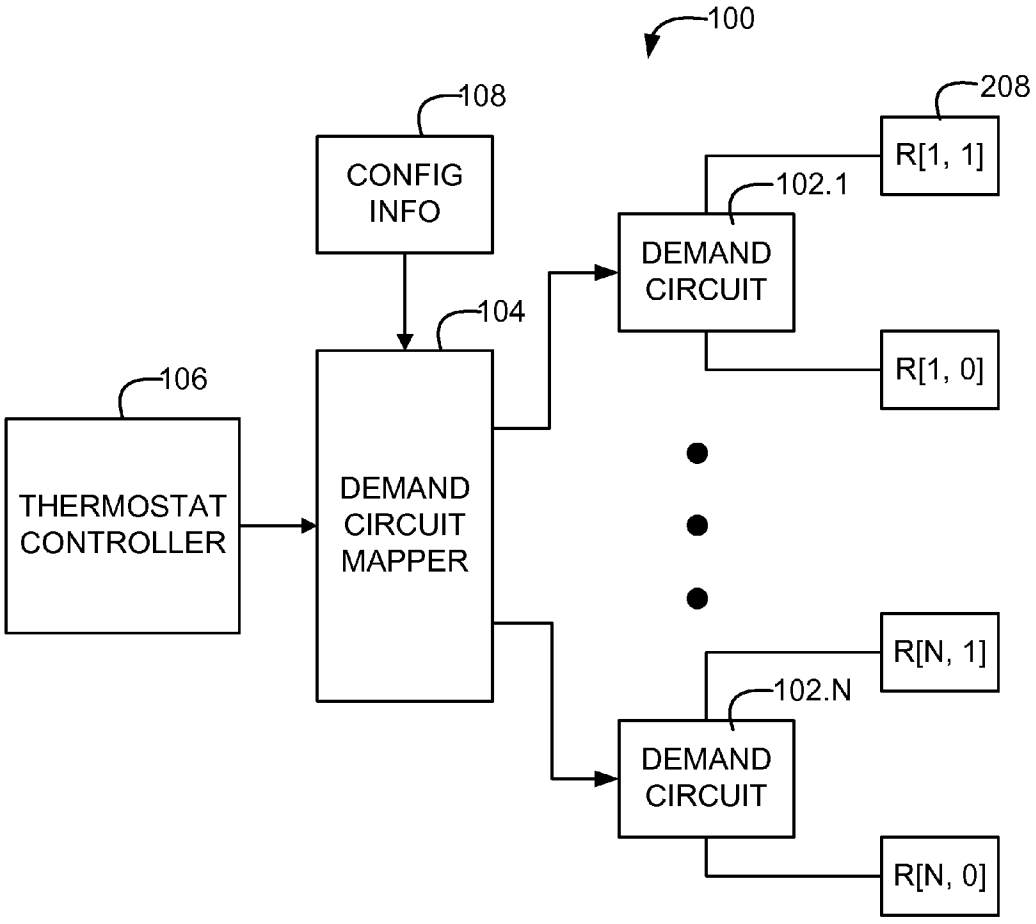
FIG. 5 illustrates another example thermostat system.

Another example embodiment of thermostat 100 is shown in FIG. 5. In the example shown in FIG. 5, thermostat system 100 includes a plurality of demand circuits [102.1 through 102.N], a demand circuit mapper 104, and a thermostat controller 106. In the example shown in FIG. 5, demand circuits 102 are configured via demand circuit mapper 104. In the embodiment shown in FIG. 5, configuration information used to configure demand circuits 102 is read from, for instance, a configuration register 108.

As noted above, thermostat 100 replaces pre-assigned, pre-marked relays with "Soft/Programmable Relays". Each relay is marked with R1, R2 . . . Rn instead of the typical HVAC lettering. An installer installing thermostat 100 uses a Smartphone, IPod, laptop, etc to select one of the supported generic system configurations, or connects via a network to an active database of available system configurations and selects a configuration from that set of configurations in the manner disclosed above. In one such approach, the installer simply selects the Vendor and Model number of the HVAC system to receive a list of possible relay configurations and wires the system accordingly.

In one embodiment, demand circuits 102.1 through 102.N include relays. In another embodiment, semiconductor devices such as triacs are used in demand circuits 102 to turn HVAC devices on or off.

In one example embodiment, thermostat 100 is used to control nontraditional devices in addition to heating, cooling and ventilation. Some such devices include solar panels, geothermal heating or even warning lights (if, for instance, a controlled room temperature is exceeding certain limit).

Figure 6:
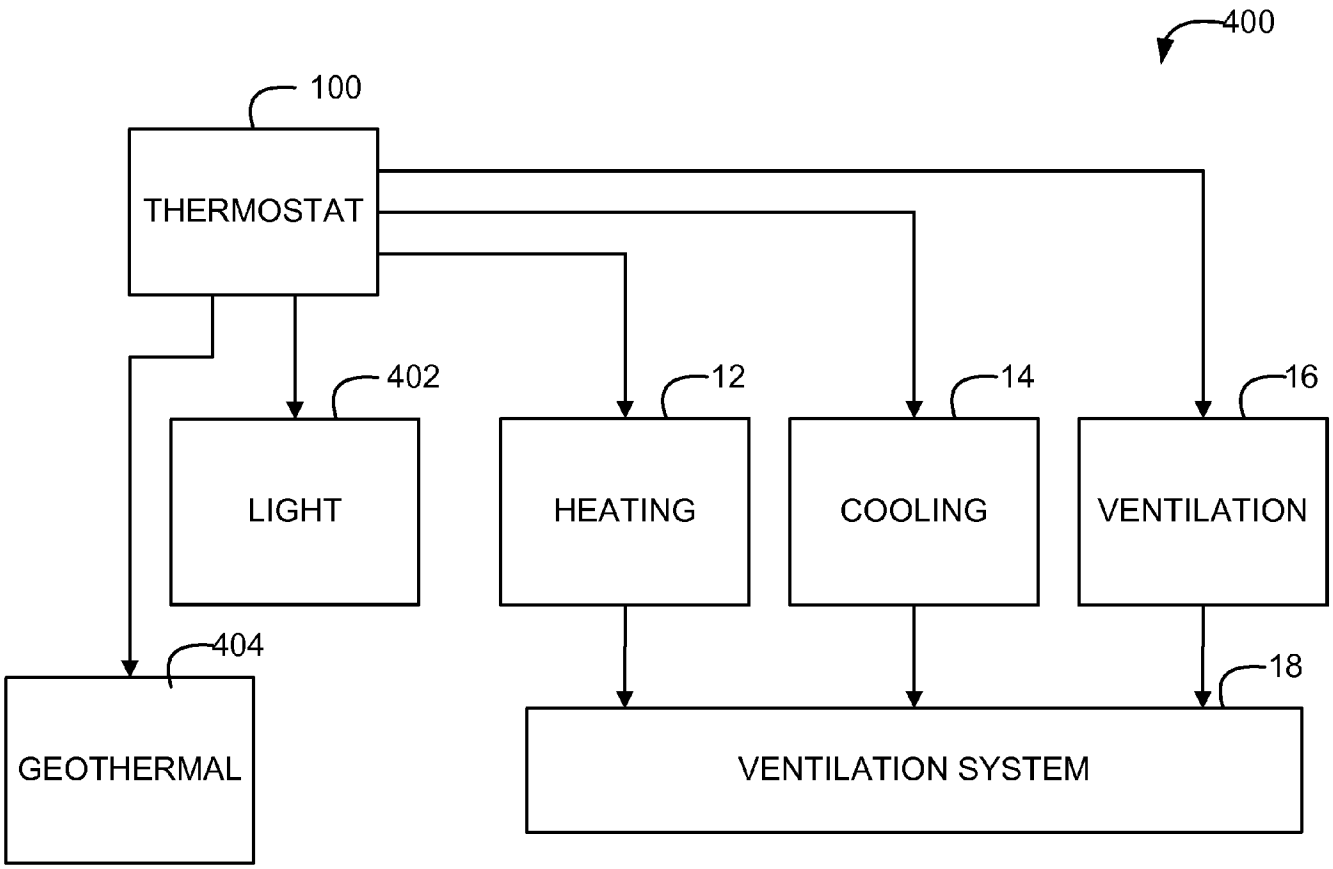
FIG. 6 illustrates another example heating, ventilation and cooling (HVAC) system.

Another example heating, ventilation and cooling (HVAC) system is shown in FIG. 6. In the example shown in FIG. 6, system 400 includes a heating unit 12, a cooling unit 14 and a ventilation unit 16 connected to the ventilation system 18 used to manage a building's climate. In the example shown in FIG. 6, system 400 also includes a geothermal unit 404 and a warning light 402 configured to light if certain environmental conditions are met (e.g., temperature in a certain room exceeds a parameter). In the example shown in FIG. 6, system 400 includes a thermostat system 100 that controls each of heating unit 12, cooling unit 14, ventilation unit 16, geothermal unit 404 and light 402 when configured by the installer in the manner described below.

Figure 7:
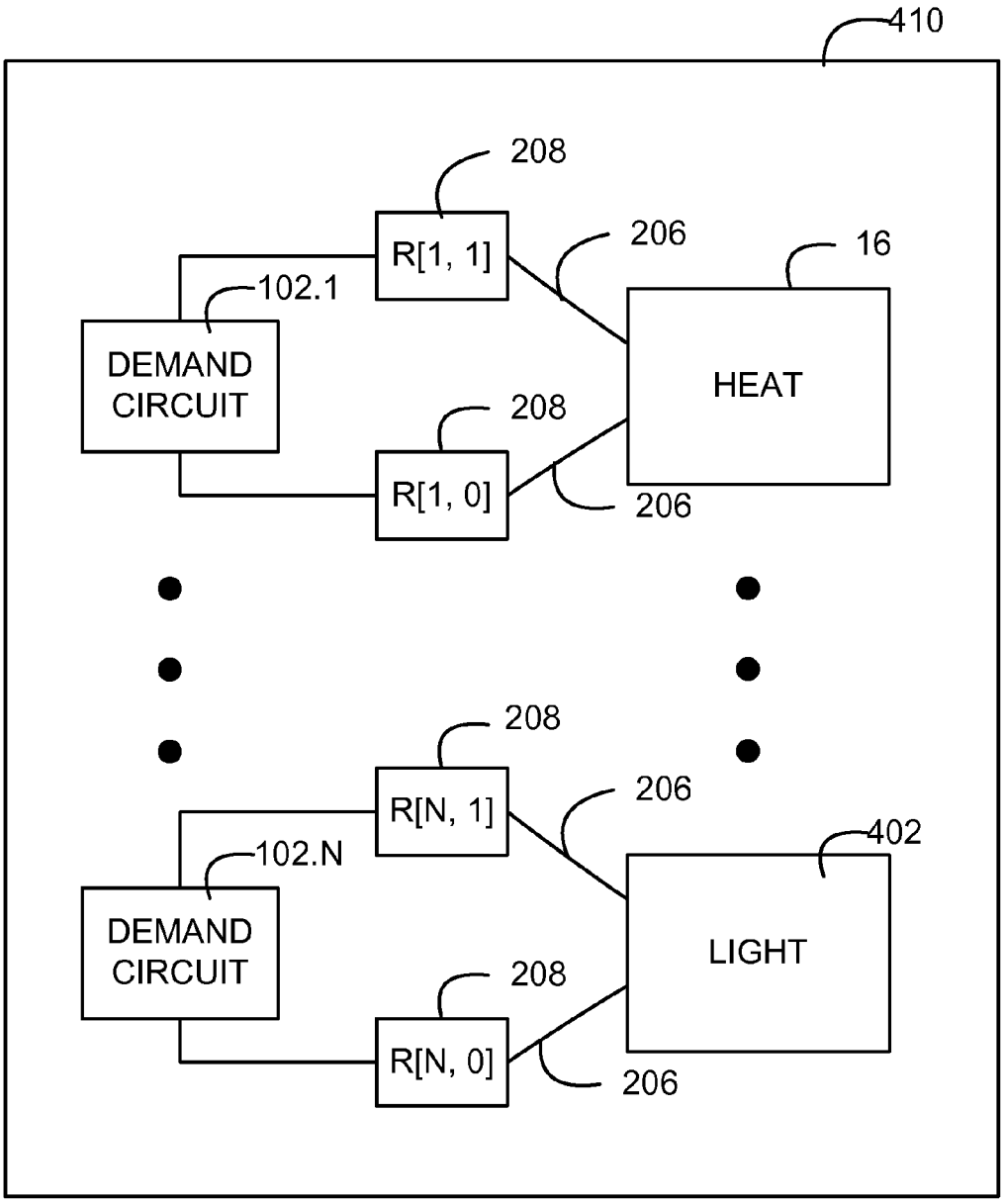
FIG. 7 illustrates a user interface that can be used to configure the thermostat system of FIG. 5.

In one example embodiment of system 400, an Install/Configurator application executing on a portable device is used to configure thermostat 100. In one example embodiment, the Install/Configurator application includes a graphical user interface such as is shown in FIG. 7. In one example embodiment, such as shown in FIG. 7, graphical user interface 410 displays a wiring diagram depicting wire assignment of the Soft Relays. In the example embodiment shown in FIG. 7, each relay includes two connections. For the relay R1, the connections are labeled as R[1,1] and R[1,0]. For the last relay R[N], the connections are labeled as R[N,1] and R[N,0]. Devices to be controlled may be labeled with generic connection names, or can be labeled with the manufacturer's name as necessary. In the example embodiment shown in FIG. 7, generic heating and lighting labels are used.

To use thermostat 100, the installer pulls up the graphical interface and displays the available relays and the possible connections. The installer connects the relay connections as desired. In the example shown in FIG. 7, the installer touches the connection R[1,1] followed by the heating unit 12 and a line 206 is drawn between the connection and the device. Once configuration is finished a configuration information table such as that shown as table 450 in FIG. 8 is used to route the appropriate control signals to the associated device connection.

A mapping which can be used to configure the home automation device 401 of FIG. 7 is shown in FIG. 8. In the mapping shown in FIG. 8, each entry 150 includes a relay wire identifier 152 and a wire assignment 154. In one embodiment, the mapping is downloaded to thermostat 100 and stored in configuration register 108, where it is used to direct control signals from thermostat 100 to their appropriate demand circuit 102.

In one such embodiment, the installer can override and manually assign the relays for a given function. An application executing thermostat 100 downloads this Soft Relay assignment via, for instance, the cloud to the device 100 and this information is then stored in the non-volatile memory (e.g., configuration register 108) of device 100 going forward.

Figure 9:
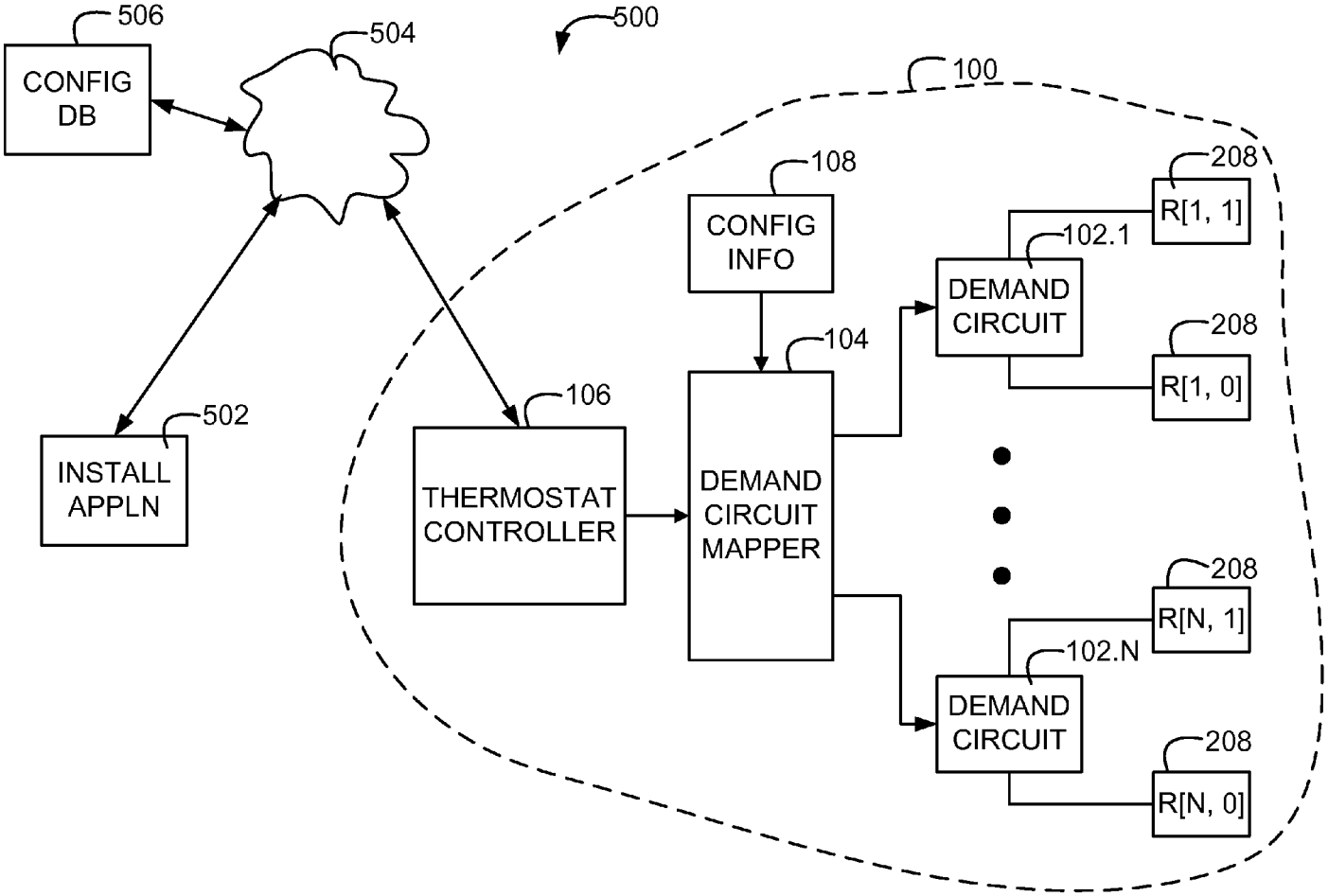
FIG. 9 illustrates another example thermostat system.

An example embodiment of a system 500 for configuring a thermostat 100 is shown in FIG. 9. In the example embodiment shown in FIG. 9, thermostat 100 includes a plurality of demand circuits [102.1 through 102.N], a demand circuit mapper 104, and a thermostat controller 106. In the example shown in FIG. 9, demand circuits 102 are controlled via demand circuit mapper 104. In the embodiment shown in FIG. 9, configuration information used to configure demand circuits 102 is read from, for instance, a configuration register 108.

In one embodiment, additional demand lines (such as second stage cooling or heating) can be used in similar configurations, or added after the fact.

In the example embodiment shown in FIG. 9, thermostat 100 is configured over a public or private network (such as, e.g., the Internet 504). In one embodiment, an installer installing thermostat 100 uses an application 502 executing on any of, e.g., a Smartphone, an IPod, laptop, etc, to select one of the supported generic system configurations, or connects via a network to an active database 506 of available system configurations and selects a configuration from that set of configurations in the manner disclosed above. In one such approach, the installer simply selects the Vendor and Model number of the HVAC system to receive a list of possible relay configurations and wires the system accordingly.

In one embodiment, configuration database 506 is an active database that is continuously updated to reflect the underlying HVAC devices. In one such embodiment, database 506 also includes documentation such as Install Guides for the thermostat 100.

In one embodiment, configuration is accomplished via a simple Web page listing all the relays and a dropdown window listing predetermined functions, such as heater, compressor, etc. In one such embodiment, the Web page includes a way for users to create user-defined functions. The user indicates the relay assignment based on this simple menu and the application then downloads a configuration file to thermostat 100. In one such approach, relay assignments are downloaded as follows:

| | |
|---|---|
| Relay_1 | [Heater] |
| Relay_2 | [Cooling] |
| . | |
| . | |
| . | |
| Relay_N | [Warning Light] |

Figure 10:
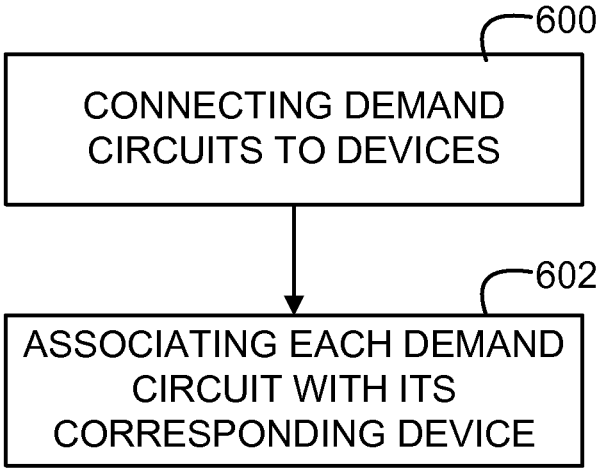
FIG. 10 illustrates a method of programming a thermostat.

An example of a method of programming thermostat 100 is shown in FIG. 10. In FIG. 10, at 600, the installer connects each demand circuit 102 to a device to be controlled. At 602, the installer associates each relay with the device that it will control and saves the configuration in memory of thermostat 100.

Figure 11:
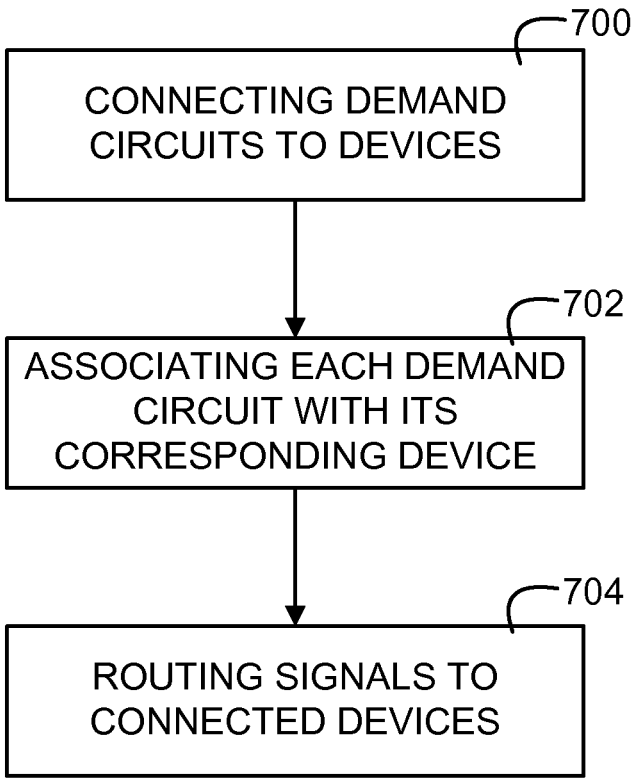
FIG. 11 illustrates a method of controlling devices within a heating, cooling and ventilation (HVAC) system.

An example of a method of controlling devices within a heating, cooling and ventilation (HVAC) system is shown in FIG. 11. In FIG. 11, at 700, the installer connects each demand circuit 102 to a device to be controlled. At 702, the installer associates each relay with the device that it will control and saves the configuration in memory of thermostat 100. At 704, signals to control each device are routed to the correct device via the configuration information stored in the memory of thermostat 100.

As noted above, a soft relay-based thermostat such as thermostat 100 has the potential to reduce the number of relays and attendant control circuitry required in a thermostat. It also allows the addition of additional functions to be controlled by that thermostat in the future.

This approach also makes installation easier, faster and more bulletproof, thus lowering cost. A user can wire the thermostat anyway he likes (Except, R, C) and then he can do the same at the main HVAC unit. In one example embodiment, the user is prompted to enter the manufacture and model number of the HVAC unit/controller and is prompted to read and enter the wiring assignment at the HVAC unit and each thermostat. The application then determines the proper configuration for each thermostat and downloads the appropriate configuration, thus eliminating any chance of incorrect wiring.

Although specific embodiments have been illustrated and described herein, it will be appreciated by those of ordinary skill in the art that any arrangement which is calculated to achieve the same purpose may be substituted for the specific embodiments shown. The invention may be implemented in various modules and in hardware, software, and various combinations thereof, and any combination of the features described in the examples presented herein is explicitly contemplated as an additional example embodiment. This application is intended to cover any adaptations or variations of the example embodiments of the invention described herein. It is intended that this invention be limited only by the claims, and the full scope of equivalents thereof.

What is claimed is:

1. A thermostat for controlling a first device and a second device in a HVAC system, comprising:

a thermostat controller;

a plurality of demand circuits, including a first and a second demand circuit;

a programmable demand circuit mapper connected to the thermostat controller and to the plurality of demand circuits; and a configuration memory that stores a mapping of demand circuit assignments used by the programmable demand circuit mapper that associates a corresponding device external to the thermostat to particular demand circuits;

wherein the programmable demand circuit mapper receives a control signal from the thermostat controller and routes that control signal to control the corresponding device via one of the plurality of demand circuits as a function of the mapping stored in the configuration memory;

wherein the thermostat controller is configured to receive demand circuit assignments across a network from a database external to the thermostat.

2. The thermostat of claim 1, wherein the configuration memory is a configuration register.

3. The thermostat of claim 1, wherein the thermostat controller includes a wireless interface to a mesh network.

4. A heating, ventilation and cooling (HVAC) system, comprising:

a plurality of devices, wherein each device performs some aspect of heating, cooling or ventilation; and a thermostat, wherein the thermostat includes:

a thermostat controller;

a plurality of demand circuits, including a first and a second demand circuit, wherein each demand circuit is connected to one of the plurality of devices;

a programmable demand circuit mapper connected to the thermostat controller and to the plurality of demand circuits; and a configuration memory that stores a mapping of demand circuit assignments that associate particular devices external to the thermostat from the plurality of devices to demand circuits connected to the particular devices;

wherein the programmable demand circuit mapper receives a mapping configuration from the thermostat controller and receives a control signal from the thermostat controller and routes that control signal to control one of the particular devices via one of the plurality of demand circuits as a function of the mapping stored in the configuration memory;

wherein the thermostat controller is configured to receive demand circuit assignments across a network from a database external to the thermostat.

5. The system of claim 4, wherein the configuration memory is a configuration register.

6. The system of claim 4, wherein the thermostat controller includes a wireless interface.

7. The system of claim 4, wherein the thermostat controller includes a wireless interface to a mesh network.

* * * * *